United States Patent [19]

Lucas et al.

[11] 4,363,180

[45] Dec. 14, 1982

[54] CABLE FERRULE IDENTIFICATION

[75] Inventors: Gerard Lucas, Croissy sur Seine; Pierre Hardouin, Asnieres, both of France

[73] Assignee: la Telemecanique Electrique, France

[21] Appl. No.: 238,408

[22] Filed: Feb. 26, 1981

[30] Foreign Application Priority Data

Feb. 29, 1980 [FR] France ..... 80 04536

[51] Int. Cl.[3] ..... G09F 3/00

[52] U.S. Cl. ..... 40/316

[58] Field of Search ..... 40/23, 2, 2.2, 316

[56] References Cited

U.S. PATENT DOCUMENTS 3,474,559 10/1969 Hunt ..... 40/316

4,199,884 4/1980 Loof ..... 40/316

FOREIGN PATENT DOCUMENTS 674239 11/1963 Canada ..... 40/316

76330 6/1948 Czechoslovakia ..... 40/316

452017 2/1968 Switzerland ..... 40/316

*Primary Examiner*—Gene Mancene

*Assistant Examiner*—Wenceslao J. Contreras

*Attorney, Agent, or Firm*—William A. Drucker

[57] ABSTRACT

A ferrule for the end of an electric cable is equipped with a removable identification tag. A skirt of the ferrule has a space adapted to receive and to retain a first extremity of a removable tag. An identification zone of the central region of the tag has a profile adapted to permit the placing in position of rings in one direction and to retain the rings against removal in the reverse direction. The ferrule is advantageously used in all electrical installations wherein the identification means of the cables have to be modified and/or are composed of different numbers of characters.

8 Claims, 6 Drawing Figures

CABLE FERRULE IDENTIFICATION

BACKGROUND OF THE INVENTION

The invention relates to a ferrule, for the end of an electric cable, comprising a tubular conductive portion adapted to receive the conductor of the cable, and a coaxial tubular insulating skirt adapted to cover the sheath of the cable, the skirt comprising a tag parallel to the axis on which are disposed rings each bearing one or several characters the association of which forms an identification sign of the cable.

Such ferrules are particularly adapted for industrial electrical insulations wherein very numerous conductors must be able to be rapidly identified either to facilitate connecting them at the time of installation or again for preventing errors of connections which could be produced in the course of replacement of defective components or apparatus; furthermore they likewise permit the simpler tracing of breakdowns in electrical circuits with the aid of checking apparatus the coupling members of which can be applied onto the terminals of active or passive apparatus utilised in these circuits.

PRIOR ART

A ferrule in accordance with the construction described hereinabove is known from French Pat. No. 1468859 assigned by the present applicants which describes a manner of construction which is advantageous when the number of characters composing the identifications individual to each of the cables used in an installation is either relatively small, or is constant, because in these cases it is unlikely that subsequent modifications of numbering would necessitate changing of the whole of the ferrule.

Nevertheless, when the number of characters to be used becomes greater, or when the identification has to be modified in an unforeseen manner after assembly of the cabling, or when by reason of association of a first installation with a second installation the number of characters to be used for their interconnection is substantially different from that which was originally necessary, it is generally necessary to de-mount a ferrule, such as that which was known previously to replace it by a new one; such a replacement necessitates the cutting of the extremity of the cable and a renewed stripping of its extremity, which results in a shortening of the cable and in a further loss of time.

OBJECT OF THE INVENTION

The invention thus proposes to provide a cable ferrule equipped with an identification means having the same advantages as those known in the prior art, but in which measures are taken permitting, on the one hand, the carrying out of a modification of the characters without necessitating the complete changing of the ferrule and, on the other hand, the preparing in advance on an independent element of an assembly of characters which have to be readily applied before or after assembly of the cabling; the invention likewise serves to provide a ferrule in which the utilisation of a reduced number of characters will not necessitate the use of an identification means having a large portion of its surface non-utilised.

SUMMARY OF THE INVENTION

According to the invention the desired result is obtained by reason of the fact that the skirt has a space disposed in a region adjacent to the sheath of the cable, and that a removable tag comprises at a first extremity means for association with the said at a second extremity opposite to the first means adapted to facilitate the threading-on of rings each bearing at least one character, said tag presenting in a central region comprised between the extremities a profile formed by a series of inclined ramps and equidistant transverse hooks adapted to facilitate the displacement of a ring towards the first extremity and respectively to prevent the displacement of a ring towards the second extremity.

BRIEF DESCRIPTION OF THE DRAWINGS

Other features of the ferrule and the identification tag will appear better from reading of the following description which describes a non-limiting manner of carrying out the invention with reference to the accompanying drawing, wherein.

DESCRIPTION OF THE PREFERRED EMBODIMENT

Figures 1, 2, 3, 4, 5:
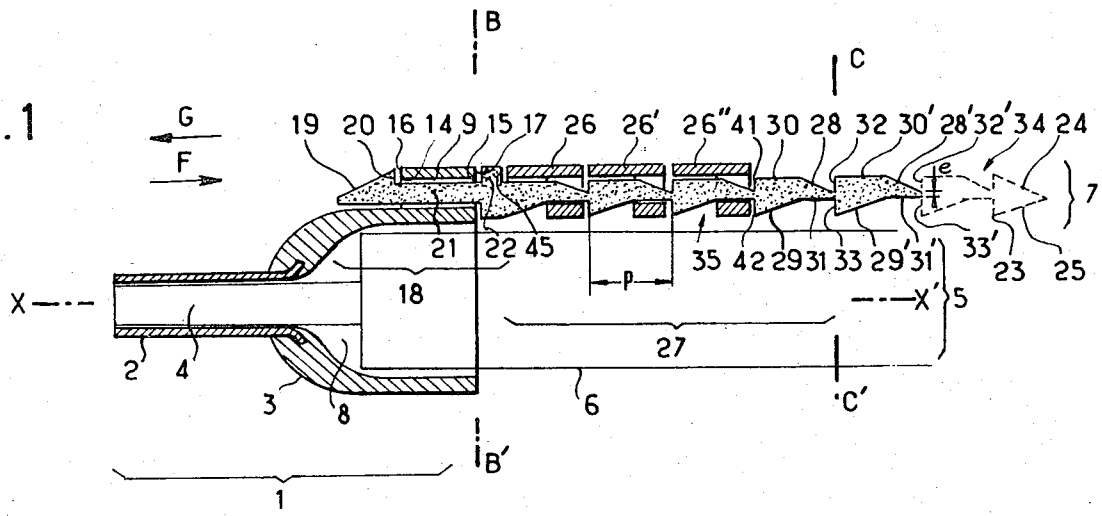
FIG. 1 shows, seen in axial section, a ferrule and its identification tag.
FIG. 2 shows a view, from the right hand side, of the ferrule according to FIG. 1.
FIG. 3 shows, seen in axial section, a ring carrying a character.
FIG. 4 shows the same ring in side view.
FIG. 5 shows a transverse section, taken on the plane cc', of the identification tag.
Figure 6:
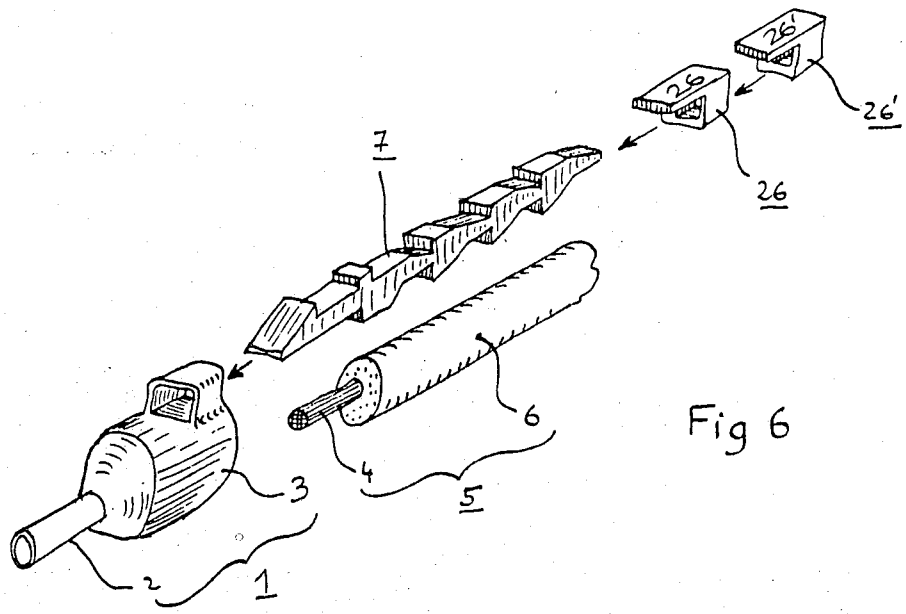
FIG. 6 is an exploded view of the ferrule and identification means assembly.

A cable ferrule 1 seen in FIG. 1 comprises a conductive tubular portion 2 with an axis XX', which is fast with an insulating skirt 3 in the shape of a funnel and coaxial with the member 2; the tubular portion is shaped to receive the conductive extremity 4 of an electric cable 5 of which a terminal part of the sheath 6 has been removed before its introduction into the ferrule; this latter is mechanically secured to the cable by a flattening of the tubular portion carried out before the positioning of the ferrule in a terminal, or in the course of tightening the terminal onto the ferrule.

A tongue constituting an identification tag 7 is associated with the ferrule to permit the identification to the cable of which it forms the end.

The skirt 3 comprises, in a region adjacent to the sheath of the cable and externally of the space 8 which receives this sheath, a second space 9 also seen in FIG. 2.

In the example of construction illustrated in FIGS. 1 and 2 the cross-section of the channel 9 is substantially rectangular and comprises internal surfaces 10, 11, 12, 13 substantially parallel to the axis XX'. This channel has two opposed apertures 14, 15 opening at two surfaces 16, 17 at least one of which 16 is substantially transverse with respect to the axis. The shape and the disposition of such a space are advantageous by reason of the fact of the simplicity which they confer on the shape of the moulds which will be necessary for the manufacture of the ferrule.

The identification tag 7, which is manufactured by moulding of an appropriate plastics material, is shown in FIG. 1 in its position of association with the ferrule 1.

This tag comprises at its first extremity 18 a ramp 19, an inclined surface or a bevel which is followed by a hook 20, a reduced portion 21, and a stop surface 22.

The ramp will permit easy placing in position of the extemity 18 into the space through the aperture 9, whilst the hook and the stop surface will assure its maintenance in axial position.

At a second extremity 23, opposite to the first, the tag likewise has at least one ramp 24 and possibly two ramps 24, 25 which will facilitate the threading-on of rings such as 26 towards a central region 27 comprised between the extremities.

The central region 27 has a profile formed by a succession of ramps 28,29; 28',29' etc. of plane surfaces 30,31; 30',31' etc., and of transverse abutment surfaces 32,33; 32',33' etc. which are repeated along this region at intervals p.

The upper region 34 of the tag opposite to the cable has, in a gap, and in a direction from the first extremity towards the second, a flat 30, a ramp 28, and an abutment surface 32, whilst the lower region 35 of the rag directed toward the cable has in the same order and respectively opposite the surfaces 30,28,32, a ramp 29, a flat 31, and an abutment 33, the two abutments being disposed in a same transverse plane CC'.

A character-bearing ring such as 26 visible in particular in FIGS. 3 and 4 has principally an internal passage 36 comprised between an upper wall 37 opposite to a lower wall 38 and between two lateral walls 39,40. The dimensions of this passage permit the threading-on of the ring, which can be made of a resilient plastics material, onto the second extremity 23, by reason of the ramps 24, 25, and permit its displacement towards the first extremity, in the course of this displacement, which is facilitated by the presence of the ramp such as 28 and 29, the ring 26 passes over corners such as 41, 42 which divide an abutment 32 from a flat 30 and which respectively separate a flat 31 from an abutment 33; accordingly the ring cannot pass back again by reason of the abutment of a lower transverse surface 43 of the ring against an abutment such as 33. The wall 37 of the ring carries on its upper external surface 44 opposite to the cable one or more characters intended to form one of the elements of an identification tag constituted by the association side by side of several identification elements 26,26',26''.

In this association each ring is retained, on the one hand, in the direction F by an abutment by reason of the fact that the length l of a ring is slightly less than p, and on the other hand in the direction G by striking against a stop 45 adjacent and opposed to the stop surface 22, or by a previously threaded-on ring.

The application of the wall 37 of the ring on the flat 30 and of the wall 38 on the flat 31 furthermore assures transverse support and good orientation of the ring.

In the example illustrated, the wall 38 has a length d substantially equal to that of the flat 31 and to that of the flat 30 which are themselves about half of the distance p separating the two stop corners such as 41.

When a number of rings, corresponding to the number of characters required, is disposed on the tag, the non-useful part of the tag is cut off at the position of the first abutment surfaces 32, 33 following, in the direction F, the last ring which has been mounted. In FIG. 1 the section is taken in the plane CC', for greater clarity.

It is also possible to cut the tag in advance to the necessary length, for example at CC' and to thereafter thread on the rings; the means adapted to facilitate this threading on are then represented by the ramp 28 and by the flat 31 which are here separated only by a thickness of material e which is small in comparison with the maximum thickness of the tag and which thus have the same properties as the ramps 24, 25.

If it is desired to complete the tag with a supplementary character, or to modify it totally, the tag is cut without disconnecting the ferrule from its terminal, at the position of the plane BB' passing through the stop surface 22, and there is introduced into the space 9 a new identification tag which at the same time pushes out the extremity 28 of the preceding one.

It is clear that certain modifications could be made to this ferrule by a person skilled in this art without departing from the scope of the present invention which illustrates an advantageous embodiment. Thus, the space 9 could communicate, at least in part, with the space 8, or a space having the same function as that shown at 9 could open at its upper part, the cross-sections of these spaces even having a shape other than the rectangular shape shown.

The tag could itself have a cross-section other than the cross-section of generally rectangular shape illustrated in the drawings; thus the flats such as 30 and/or the ramps 29 could have a convex shape 30''', 28''', 29''' illustrated in FIG. 5; it would likewise be possible to use, if for example the rings are self-coloured and their signification is thus independent of their orientation, a tag having a cross-section of generally circular shape and presenting an axial series of hollows and/or annular bosses intended to localise and to maintain rotatable rings.

We claim:

1. The assembly of a ferrule for the end of an electric cable having a conductive end portion and a sheath and of removable identification means, said ferrule comprising a tubular conductive portion having an axis of revolution and adapted to receive the said conductive end portion of the cable and a coaxial insulating skirt having a tubular hollow portion which is adapted to cover the said sheath of the cable, the said skirt further having a channel portion located outside the tubular hollow portion and adjacent thereto, said channel portion being substantially parallel to the said axis, and said identification means including an elongated tag having first and second ends and intermediate length portion, said first end being shaped for removable engagement into the said channel to secure the tag along the said sheath, at a distance thereof, in a direction substantially parallel to the said axis, the said intermediate portion forming a plurality of uniformly spaced projections, the cross section of which is decreasing in the direction of the said second end and each comprising an inclined ramp and a transverse abutment surface; said identification means further comprising a plurality of character-bearing rings removably slipped on said tag.

2. An assembly according to claim 1, wherein said channel portion of substantially rectangular cross-section has inner walls parallel to the said axis and is opened at both ends.

3. Assembly according to claim 2, wherein the said first end of the tag is shaped as a hook having a stop surface which abuts against the corresponding end of the said channel portion.

4. Assembly according to claim 1, wherein the second end of the tag has at least one ramp.

5. An assembly according to claim 1, wherein the tag is made of plastics material and has, connecting the adjacent projections, portions of substantially reduced cross-section.

6. An assembly according to claim 5, wherein the tag has inner and outer surfaces and each projection comprises, in a direction going from the said first end to the said second end, at its outer surface a flat, an inclined ramp and a first transverse abutment and, at its inner surface a further inclined ramp, a further flat and a second transverse abutment, first and second abutments being disposed in the same plane in which the said portions of substantially reduced cross-section are located.

7. An assembly according to claim 1, wherein each of the said rings has outer and inner substantially parallel walls, the outer wall having a length which is substantially equal to the distance of the abutment surfaces of two adjacent projections and the inner wall having a length which is substantially smaller than the said distance.

8. An assembly according to claim 1, wherein the tag has inner and outer convex surface portions.

* * * * *